United States Patent [19]

Fujioka et al.

[11] Patent Number: 4,686,426

[45] Date of Patent: Aug. 11, 1987

[54] THIN-FILM EL DISPLAY PANEL DRIVE CIRCUIT WITH VOLTAGE COMPENSATION

[75] Inventors: Yoshihide Fujioka; Shigeyuki Harada; Toshihiro Ohba; Yoshiharu Kanatani, all of Nara; Hisashi Uede, Wakayama, all of Japan

[73] Assignee: Sharp Kabushiki Kaisha, Osaka, Japan

[21] Appl. No.: 780,177

[22] Filed: Sep. 26, 1985

[30] Foreign Application Priority Data

Sep. 28, 1984 [JP] Japan ..... 59-205428

[51] Int. Cl.[4] ..... H01Q 19/14

[52] U.S. Cl. ..... 315/169.3; 315/169.2; 340/781; 340/825.81

[58] Field of Search ..... 315/169.3, 169.2, 107; 340/781, 825.81

[56] References Cited

U.S. PATENT DOCUMENTS

| | | | |
|---|---|---|---|
| 3,885,196 | 5/1975 | Fischer | 340/781 |
| 4,032,818 | 6/1977 | Chan | 315/169.2 |
| 4,338,598 | 7/1982 | Ohba et al. | 340/825.81 |
| 4,485,379 | 11/1984 | Kinoshita et al. | 340/825.81 |

FOREIGN PATENT DOCUMENTS

| | | | |
|---|---|---|---|
| 3511886 | 10/1985 | Fed. Rep. of Germany . | |
| 2149182 | 6/1985 | United Kingdom | 340/781 |
| 2158982 | 11/1985 | United Kingdom . | |
| 2161306 | 1/1986 | United Kingdom . | |
| 2165078 | 4/1986 | United Kingdom . | |

*Primary Examiner*—David K. Moore
*Assistant Examiner*—Theodore C. Salindong
*Attorney, Agent, or Firm*—Birch, Stewart, Kolasch & Birch

[57] ABSTRACT

A thin-film EL display panel drive circuit capable of varying the drive voltage according to changes in the number of emitting picture elements.

6 Claims, 9 Drawing Figures

THIN-FILM EL DISPLAY PANEL DRIVE CIRCUIT WITH VOLTAGE COMPENSATION

BACKGROUND OF THE INVENTION

The present invention relates to a thin-film EL (Electro-luminescent) display panel drive circuit and, more specifically, to a thin-film EL display panel drive circuit that applies a virtually constant emitting voltage to electrodes in the thin-film EL display panel regardless of changes in the number of emitting picture elements.

In the conventional thin-film EL display panel drive circuit, transistor voltage drops when the number of emitting picture elements changes. Voltage actually applied to the electrodes of the thin-film EL display panel then drops accordingly. Thus, the electrodes do not receive a constant voltage. The result is irregular luminance and inferior display quality.

SUMMARY OF THE INVENTION

In view of the foregoing, it is an object of the present invention to provide a thin-film EL display panel drive circuit that is capable of applying a constant or virtually constant emitting voltage to electrodes in the thin-film EL display panel, even when the number of emitting picture elements changes.

Another object of the invention is to provide a thin-film EL display panel drive circuit which adjusts the driving voltage according to display data load fluctuations in consideration of MOS IC ON-resistance, so that a constant or virtually constant emitting voltage is applied to electrodes in the thin-film EL display panel irrespective of load fluctuations, thereby eliminating luminance irregularity resulting from display data variations and improving display quality.

A further object of the invention is to provide a thin-film EL display panel drive circuit with improved shadowing characteristics (luminance drops associated with increases in the number of emitting picture elements in one scan line due to insufficient driver capacity in the EL display panel).

Other objects and the further scope of applicability of the present invention will become apparent from the detailed description given hereinafter. It should be understood, however, that the detailed description and specific examples, while indicating the preferred embodiments of the invention, are given by way of illustration only; various changes and modifications within the spirit and scope of the invention will become apparent to those skilled in the art from this detailed description.

With the above objects in view, a thin-film EL display panel drive circuit used in the present invention drives the EL display panel via time division and is provided with a means of varying driving voltage according to changes in the number of emitting picture elements.

BRIEF DESCRIPTION OF THE DRAWINGS

The present invention will be more fully understood from the detailed description given hereinbelow and the accompanying drawings which are given by way of illustration only, and thus not limitative of the present invention and wherein.

DETAILED DESCRIPTION OF THE INVENTION

Figure 2:
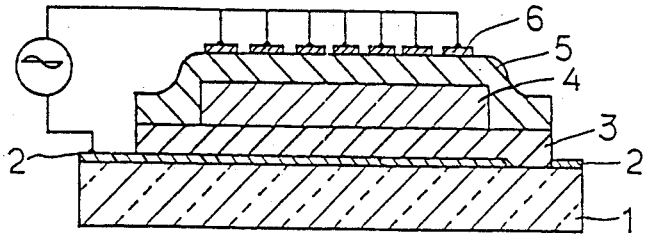
FIG. 2 is a construction drawing of a basic thin-film EL display panel.

Referring to FIG. 2, which shows the basic construction of the thin-film EL display panel used in the present invention, (4) denotes a ZnS emitting layer to which Mn is added as an active material for emitting center definition. (3) and (5) are dielectric layers composed of $Si_3N_4$, $SiO_2$ or $Al_2O_3$. (2) is a transparent electrode whose display side is composed of In.T.O. (Indium Tin Oxide) and (6) is a counter electrode of Al. (1) is a glass substrate.

Figure 3:
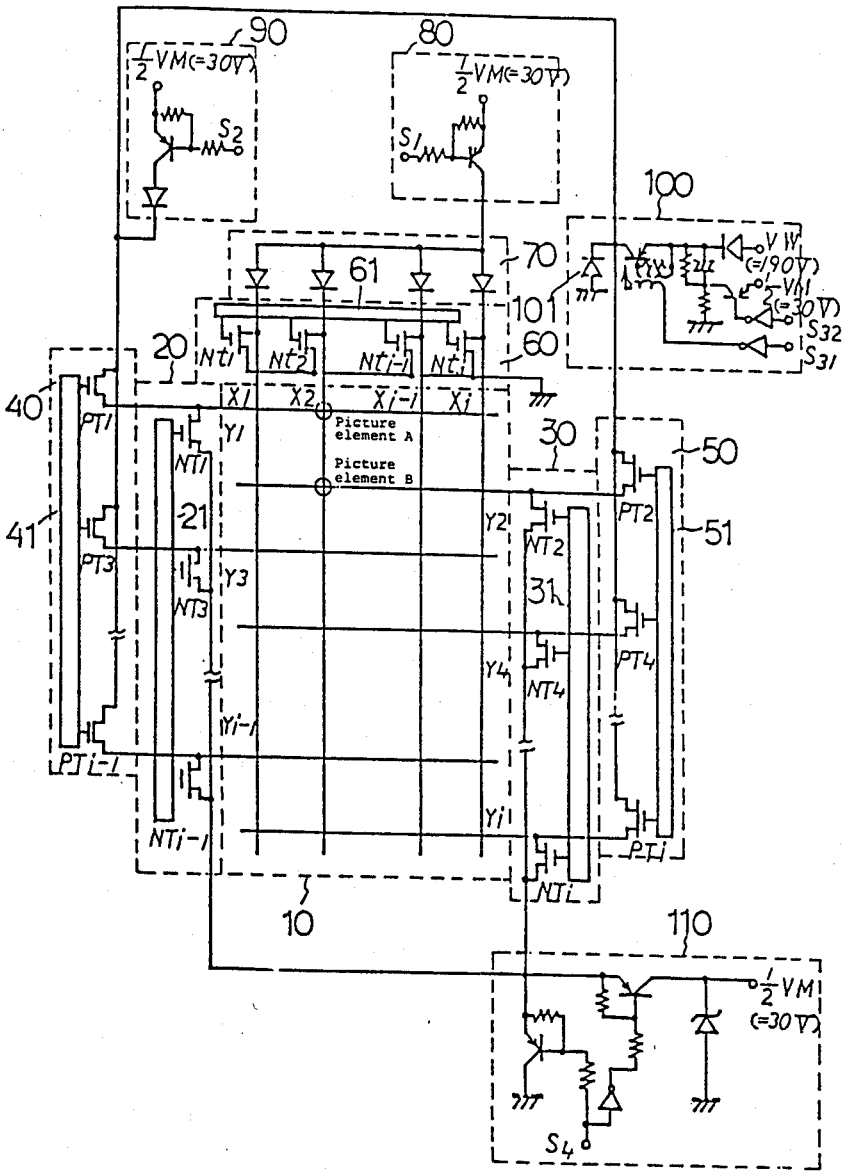
FIG. 3 is a circuit diagram of the thin-film EL display panel drive circuit constituting the basis of the present invention.

Referring to FIG. 3, showing the thin-film EL display panel drive circuit constituting the basis of the present invention, (10) denotes a thin-film EL display panel. In this figure, only electrodes are shown, with data side electrodes in the X direction and scan side electrodes in the Y direction. (20) and (30) are scan side N-channel high-withstand MOS IC's for the electrodes in the X direction on an odd and even line, respectively. (21) and (31) are logic circuits, such as IC shift registers. (40) and (50) are scan side P-channel high-withstand MOS IC's for the electrodes in X direction on odd and an even lines, respectively, (41) and (51) are logic circuits, such as IC shift registers. (60) is a data side N-channel high-withstand MOS IC, and (61) is a logic circuit, such as an IC shift register. (70) is a data side diode array which divides the data side driving line and which provides reverse bias protection for the switching elements. (80) is a precharge driving circuit, (90) a pull-up charge drive circuit, and (100) a write-drive circuit. (110) is a source potential switch circuit for the scan side N-channel high-withstand MOS IC (20) and (30) and is normally kept at ground potential.

Operation of the basic drive circuit in the present invention will be described below in reference to FIGS. 4 and 5.

Figure 4:
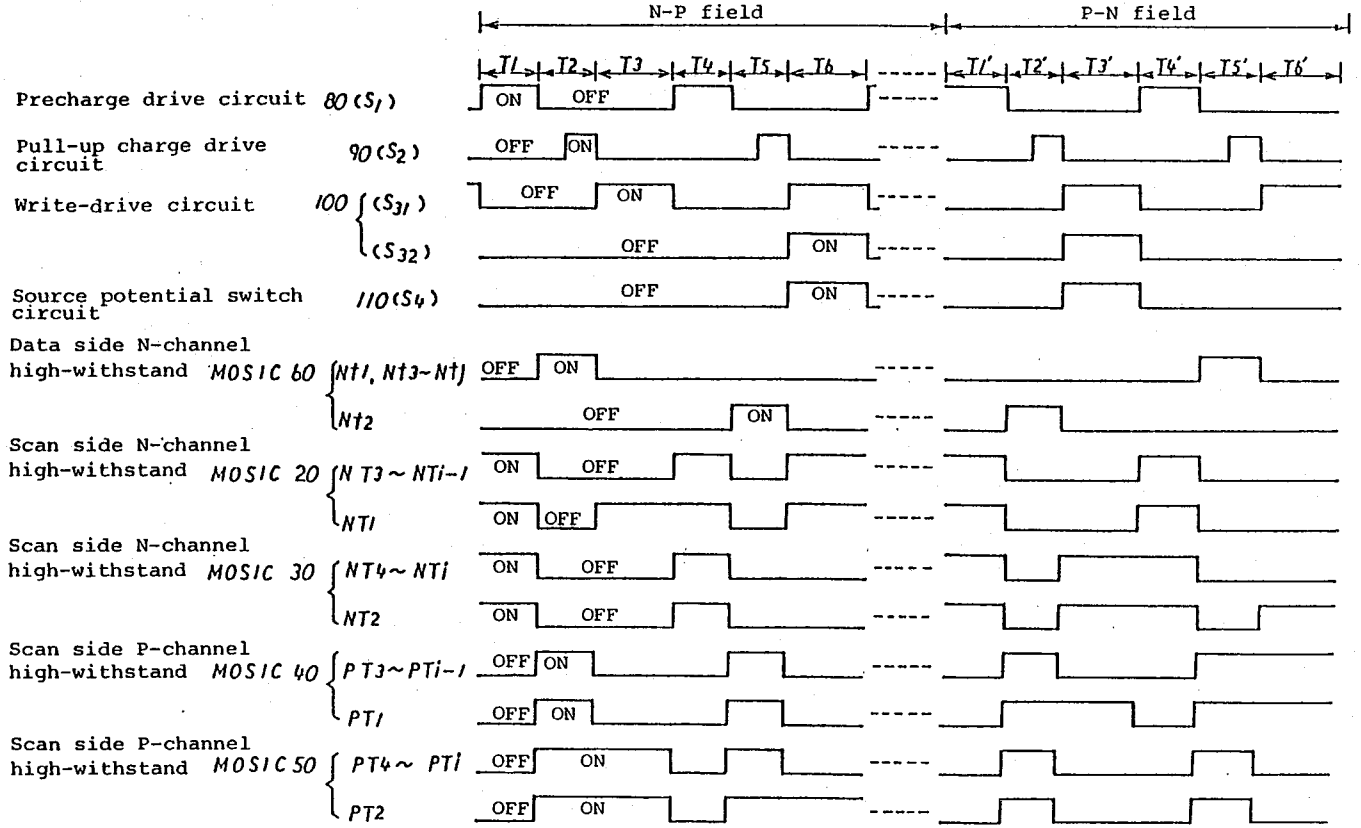
FIG. 4 is a waveform chart showing the ON-OFF times of each high withstand MOS transistor, drive circuit and the potential switch circuit.

ON-OFF timings of each high-withstand MOS transistor, each drive circuit, and the potential switch circuit are shown in FIG. 4. Applied voltage waveforms and emitting waveforms of picture elements A and B (FIG. 3) are shown in FIG. 5.

Here, description rests on the assumption that the scan side electrodes $Y_1$ and $Y_2$, containing picture elements A and B, respectively, are selected by line sequential drive. As discussed later, the polarity of voltage applied to the picture elements is reversed for each line. The field in which a positive write pulse is applied to picture elements on an odd line is called N-P field, while the field in which a positive write pulse is applied to picture elements on an even lines is called P-N field.

N-P field (A) Drive for the 1st line (odd line), including the picture element A, is as follows: 1st step $T_1$: Precharge period (odd line)

The source potential switch circuit (110) is set at ground potential; all MOS transistors $NT_1 \sim NT_i$ in the scan side N-channel high-withstand MOS IC's (20) and (30) are turned ON. Simultaneously, precharge drive circuit (80) (voltage $\frac{1}{2}VM=30$ V) is turned ON to charge the entire panel through the data side diode array (70). Meanwhile, all MOS transistors $Nt_1 \sim Nt_i$ in the data side N-channel high-withstand MOS IC (60) and all MOS transistors $PT_1 \sim PT_i$ in the scan side P-channel high-withstand MOS IC's (40) and (50) remain OFF. 2nd step $T_2$: Discharge/pull-up charge period (odd line)

All MOS transistors $NT_1 \sim NT_i$ in scan side N-channel high-withstand MOS IC's (20) and (30) are turned OFF. When a MOS transistor (for example $Nt_2$) is connected to a selected data side drive electrode (for example, $X_2$) with the data side N-channel high-withstand MOS IC (60) OFF, MOS transistors $Nt_1$ and $Nt_3 \sim Nt_j$, connected to all non-selected data side drive electrodes, are turned ON. Simultaneously, all MOS transistors $PT_1 \sim PT_i$ in the scan side P-channel high-withstand MOS IC's (40) and (50) are turned ON. The MOS transistors $Nt_1 \sim Nt_j$ (excluding $Nt_2$) which are now ON in the data side N-channel high-withstand MOS IC (60) form a ground loop together with the MOS transistors $PT_1 \sim PT_i$ in the scan side P-channel high-withstand MOS IC's (40) and (50) and the diode (101) in the write drive circuit (100), for discharging data side non-selected electrodes ($X_j \neq 2$).

The pull-up charge drive circuit (voltage: $\frac{1}{2}$ VM=30 V) is then turned ON to raise potentials of all scan side electrodes to 30 V. During this time, all MOS transistors $NT_1 \sim NT_i$ in the scan side N-channel high-withstand MOS IC's (20) and (30) remain OFF. Accordingly, when measured in reference to scan side electrodes (Y), potential of the selected data side electrode ($X_2$) is +30 V and that of non-selected data side electrodes ($X_j \neq 2$) is −30 V.

3rd step $T_3$: Write-drive period (odd line)

Since scan side electrode $Y_1$ has been selected by the line sequential drive, only the MOS transistor $NT_1$ connected to Y: in scan side N-channel high-withstand MOS IC (20) is turned ON; all MOS transistors $PT_1 \sim PT_{i-1}$ in P-channel high-withstand MOS IC (40) on odd lines are turned OFF. During this time, all MOS transistors $PT_2 \sim PT_i$ in opposing P-channel high-withstand MOS IC (50) on even lines remain ON. Simultaneously, write-drive circuit (100) (voltage: VW=190 V) is turned ON to raise all scan side electrodes on even lines to 190 V through MOS transistors $PT_2 \sim PT_i$ in the P-channel high-withstand MOS IC (50) on even lines. Thus, due to capacitive coupling, voltage of data side selected electrode is raised to VW+$\frac{1}{2}$ VM=220 V, and that of the data side non-selected electrode is raised to VW−$\frac{1}{2}$ VM=160 V.

(B) Drive for the 2nd line (even line), including the picture element B, is as follows:

4th step $T_4$: Precharge period (even line)

Operation during precharge period is the same as in the N-P field 1st step.

5th step $T_5$: Discharge/pull-up charge period (even line)

All MOS transistors $NT_1 \sim NT_i$ in scan side N-channel high-withstand MOS IC's (20) and (30) are turned OFF. When the MOS transistor (for example $Nt_2$) is connected to a selected data side drive electrode which is ON, MOS transistors $Nt_1 \sim Nt_j$ (excluding $Nt_2$) connected to data side non-selected drive circuits are turned OFF in data side N-channel high-withstand MOS IC (60). Simultaneously, all MOS transistors $PT_1 \sim PT_i$ in scan side P-channel high-withstand MOS IC's (40) and (50) are turned ON. MOS transistor $Nt_2$ now ON and thus set to a ground potential in the data side N-channel high-withstand MOS IC (60), forms a ground loop together with MOS transistors $PT_1 \sim PT_i$ in scan side P-channel high-withstand MOS IC's (40) and (50) and diode (101) in the write drive circuit (100), discharging data side selected electrode.

Next, pull-up charge drive circuit (90) is turned ON to raise the potential of all scan side electrodes (Y) to $\frac{1}{2}$ VM=30 V. During this time, MOS transistors $NT_1 \sim NT_i$ in scan side N-channel high-withstand MOS IC's (20) and (30) remain OFF. Accordingly, when measured in reference to scan side electrode (Y), potential of selected data side electrode ($X_2$) is −30 V and that of non-selected electrodes ($X_j \neq 2$) is +30 V.

6th step $T_6$: Write-drive period (even line)

Since the scan side electrode $Y_2$ has been selected, all MOS transistors except $PT_2$ connected to $Y_2$ in the scan side P-channel high-withstand IC (50) are turned OFF. With MOS transistors $NT_2 \sim NT_i$ in the scan side N-channel high-withstand MOS IC (30) on the even lines OFF, MOS transistors $NT_1 \sim NT_{i-1}$ in the opposing scan side N-channel high-withstand MOS IC (20) on the odd line are turned ON. The write-drive circuit (100) (voltage: the sum of VW=190 V and $\frac{1}{2}$ VM=30 V) is turned ON to apply 220 V voltage to the scan side electrode $Y_2$ through MOS transistor $PT_2$, which is ON. Meanwhile, source potential switch circuit (110) is switched over to $\frac{1}{2}$ VM=30 V voltage so that, with source potential in the N-channel high-withstand MOS IC (20) on the odd lines at 30 V, the scan side electrode voltage on the odd lines is reduced to +30 V. Thus, due to capacitive coupling, voltage of data side selected drive electrode ($X_2$) is reduced to −220 V, and that of data side non-selected electrodes ($X_j \sim 2$) is reduced to −160 V.

Drive for the N-P field is completed when steps $T_1 \sim T_3$ have been conducted sequentially on odd lines and steps $T_4 \sim T_6$ on even lines.

P-N field (A) Drive for the 1st line (odd line), including the picture element A in the P-N field, is as follows:

1st step $T_1'$: Precharge period (odd line)

Operation during precharge period is the same as in the N-P field 1st step.

2nd step $T_2'$: Discharge/pull-up charge period (odd line)

Operation during the discharge/pull-up charge period is the same as in N-P field 5th stage.

3rd step $T_3'$: Write-drive period (odd line)

Since scan side electrode $Y_1$ has been selected, all MOS transistors except $PT_1$ connected to $Y_1$ in scan side P-channel high-withstand MOS IC (40) are turned OFF. While MOS transistors $NT_1 \sim NT_{i-1}$ in scan side N-channel high-withstand MOS IC (20) on odd lines remain OFF, MOS transistors $NT_2 \sim NT_i$ in the opposing scan side N-channel high-withstand MOS IC (30) on the even lines are turned ON. The write-drive circuit (100) (voltage = the sum of VW = 190 V and $\frac{1}{2}$ VM = 30 V) is then turned ON to supply 220 V voltage to scan side electrode $Y_1$ through MOS transistor $PT_1$, which is ON. Meanwhile, source potential switch circuit (110) is switched over for $\frac{1}{2}$ VM = 30 V voltage so that, with source potential in N-channel high-withstand MOS IC (30) on even lines at 30 V, scan side electrode voltage on even lines is reduced to +30 V. Thus, due to capacitive coupling, voltage of data side selected drive electrode ($X_2$) is reduced to −220 V, and that of data side non-selected electrodes ($X_{j \neq 2}$) is reduced to −160 V.

(B) Drive for the 2nd line (even line), including the picture element B, is as follows:

4th step $T_4'$: Precharge period (even line)

Operation during precharge period is the same as in the N-P field 1st step.

5th step $T_5'$: Discharge/pull-up charge period (even line)

Operation during the discharge/pull-up charge period is the same as in N-P field 2nd step.

6th step $T_6'$: Write-drive period (even line)

Since scan side electrode $Y_2$ has been selected by the line sequential drive, only the MOS transistor $NT_2$ connected to $Y_2$ in scan side N-channel high-withstand MOS IC (30) is turned ON; MOS transistors $PT_2 \sim PT_i$ on even lines in the P-channel high-withstand MOS IC (50) are turned OFF. At this time, MOS transistors $PT_1 \sim PT_{i-1}$ on odd lines in the opposing P-channel high-withstand MOS IC (40) are kept ON. Simultaneously, the write-drive (100) (voltage VW = 190 V) is turned ON to raise potentials of scan side electrodes on odd lines to 190 V through MOS transistors $PT_1 \sim PT_{i-1}$ on odd lines in the P-channel high-withstand MOS IC (40). Thus, due to capacitive coupling, potential of the data side selected drive electrode is raised to VW + $\frac{1}{2}$ VM = 220 V, and that of data side non-selected electrodes to VW + $\frac{1}{2}$ VM = 160 V.

Drive for the P-N field is completed when steps $T_1 \sim T_3'$ have been conducted sequentially on odd lines and steps $T_4' \sim T_6'$ on even lines.

Figure 5:
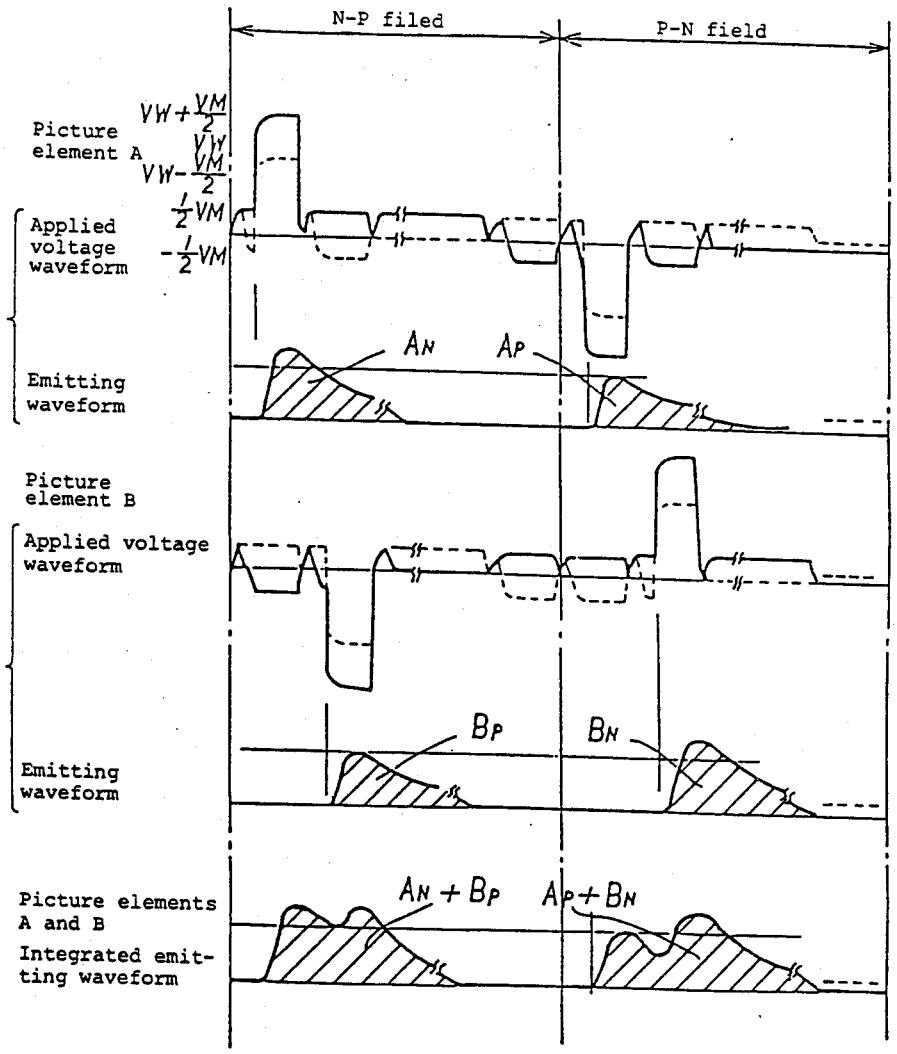
FIG. 5 shows applied voltage waveforms and emitting waveforms of picture elements A and B in FIG. 3.

As seen in the time chart in FIG. 5, when alternate drives for the N-P field and the P-N field are as described above, write voltage of VW + $\frac{1}{2}$ VM (= 220 V), whose polarities in the N-P and P-N fields are reversed, is applied to picture elements at selected intersections. Write voltage thus applied is sufficiently high for luminous emissions. The alternating cycle needed for the thin-film EL display panel is thus closed by two fields—the N-P field and the P-N field. The non-selected picture elements receive a voltage of VW − $\frac{1}{2}$ VM (= 160 V), which is lower than emitting threshold value.

Furthermore, differences in emitting intensity between fields can be eliminated since write voltage is applied with a polarity reversed for every line. (Waveforms $A_N$ and $A_P$ for picture element A as well as wave forms $B_P$ and $B_N$ for picture element B in FIG. 5 differ in emitting amount, but integrated waveforms ($A_N + B_P$) and ($A_P + B_N$) for picture elements A and B are equal.) Accordingly, it is possible to reduce flickers caused by differences in emitting intensity between fields, which can result from applying write voltages with polarity reversed for every field. Actually, emitting intensity differs between lines, but flickers are not visible because the differences are equalized.

As understood from the above, field-reversed drive is conducted with N-channel and P-channel high-withstand MOS drivers acting as a scan side electrode drive circuit, reversing the polarity of the write voltage applied to picture elements for every line. Emitting intensity fluctuations caused by applying reversed polarity voltages to the panel are thus equalized, reducing flickers. A useful drive circuit providing favorable display quality is thus obtained.

Figure 6:
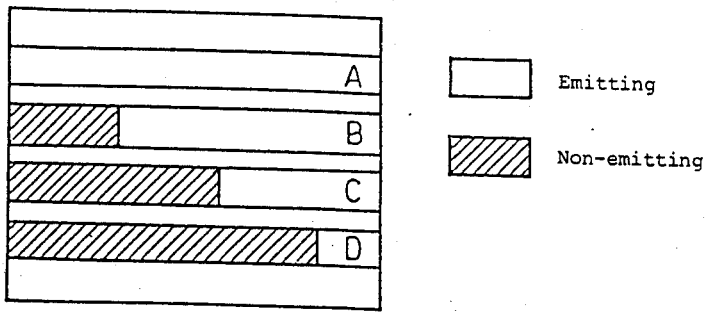
FIG. 6 shows sample emitting picture elements from the thin-film EL display panel.

In the circuit having N-channel and P-channel high-withstand MOS drivers acting as a scan side electrode drive circuit, as shown in FIG. 3, a problem arises if voltage is applied to the picture elements with polarity reversed for every line. Specifically, assuming scan side electrode $Y_S$ has been selected at the time of applying the negative write pulse to the picture elements on the scan side selected line, only MOS transistor $PT_S$ connected to $Y_S$ in the scan side P-channel high-withstand MOS IC is turned ON at write time. At this time, voltage actually applied to electrodes in the thin-film EL display panel from the write-drive circuit is low, due to the voltage drop resulting from MOS transistor $PT_S$'s ON-resistance. The degree of voltage drop varies depending upon the emitting amount (DATA) on one line; the larger the number of emitting elements, the larger the load current and voltage drop due to the ON-resistance of the MOS transistor become. Therefore, if the display shown in FIG. 6 is presented on the panel using the circuit shown in FIG. 3, portions A, B, C and D may have different luminances, such as A < B < C < D, though essentially they should provide similar luminance. That is, with modulation for each line, inferior display quality may result.

Meanwhile, voltage drop due to the ON-resistance of the N-channel MOS IC is small because the ON-resistance itself is low. Therefore, voltage drop or its fluctuation in the N-channel MOS IC has a negligibly small influence on luminance, compared with the influence of P-channel MOS IC ON-resistance.

Figure 1:
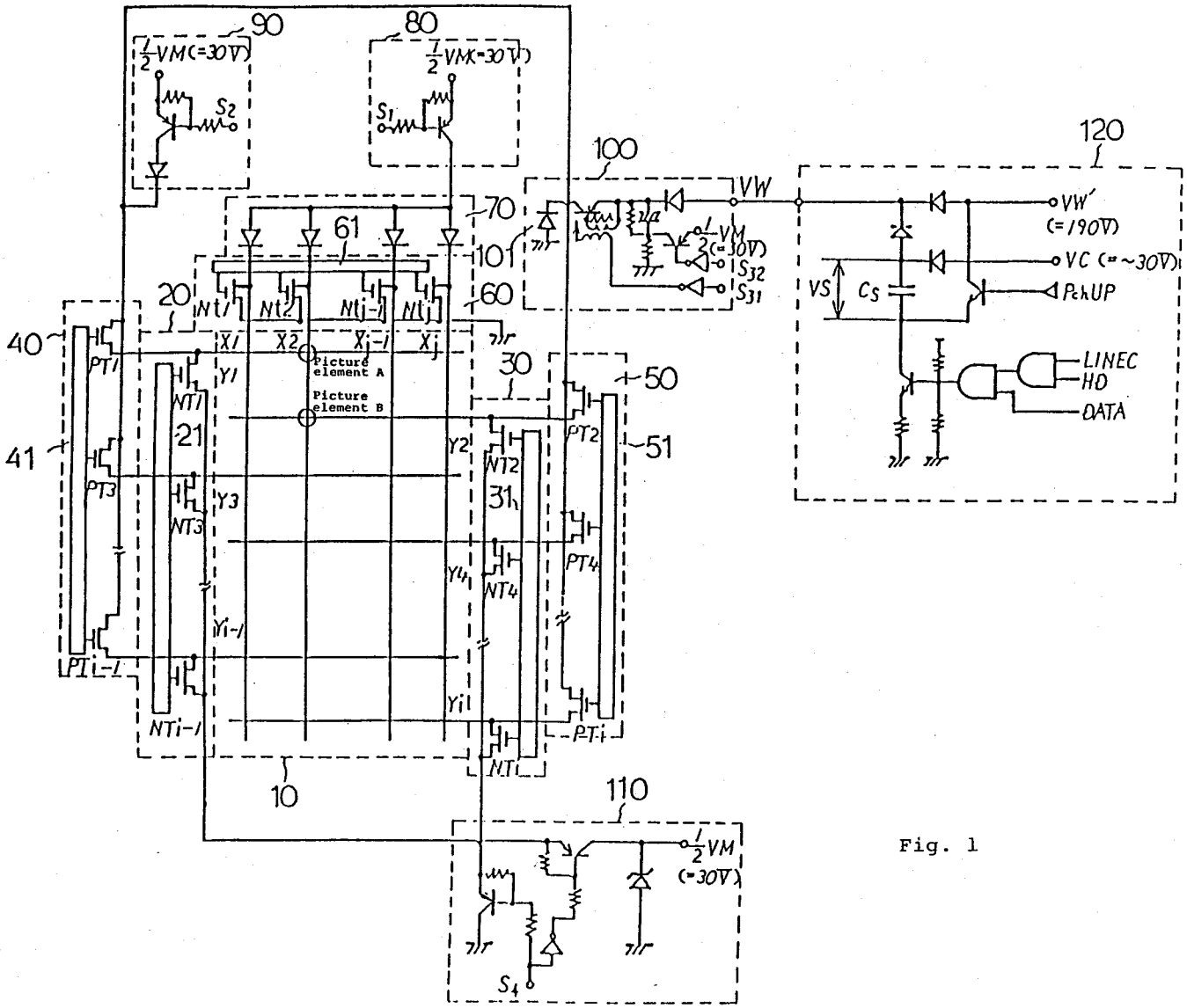
FIG. 1 is a circuit diagram of a thin-film EL display panel drive circuit used in the present invention.
Figure 7:
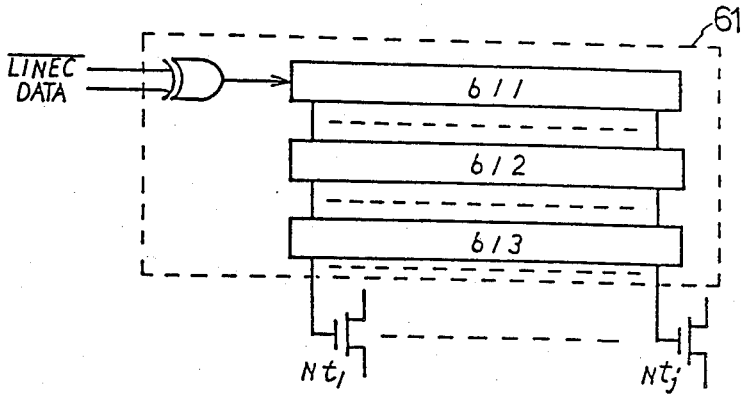
FIG. 7 is a block diagram showing the internal construction of logic circuit (61) in FIG. 1.
Figure 8:
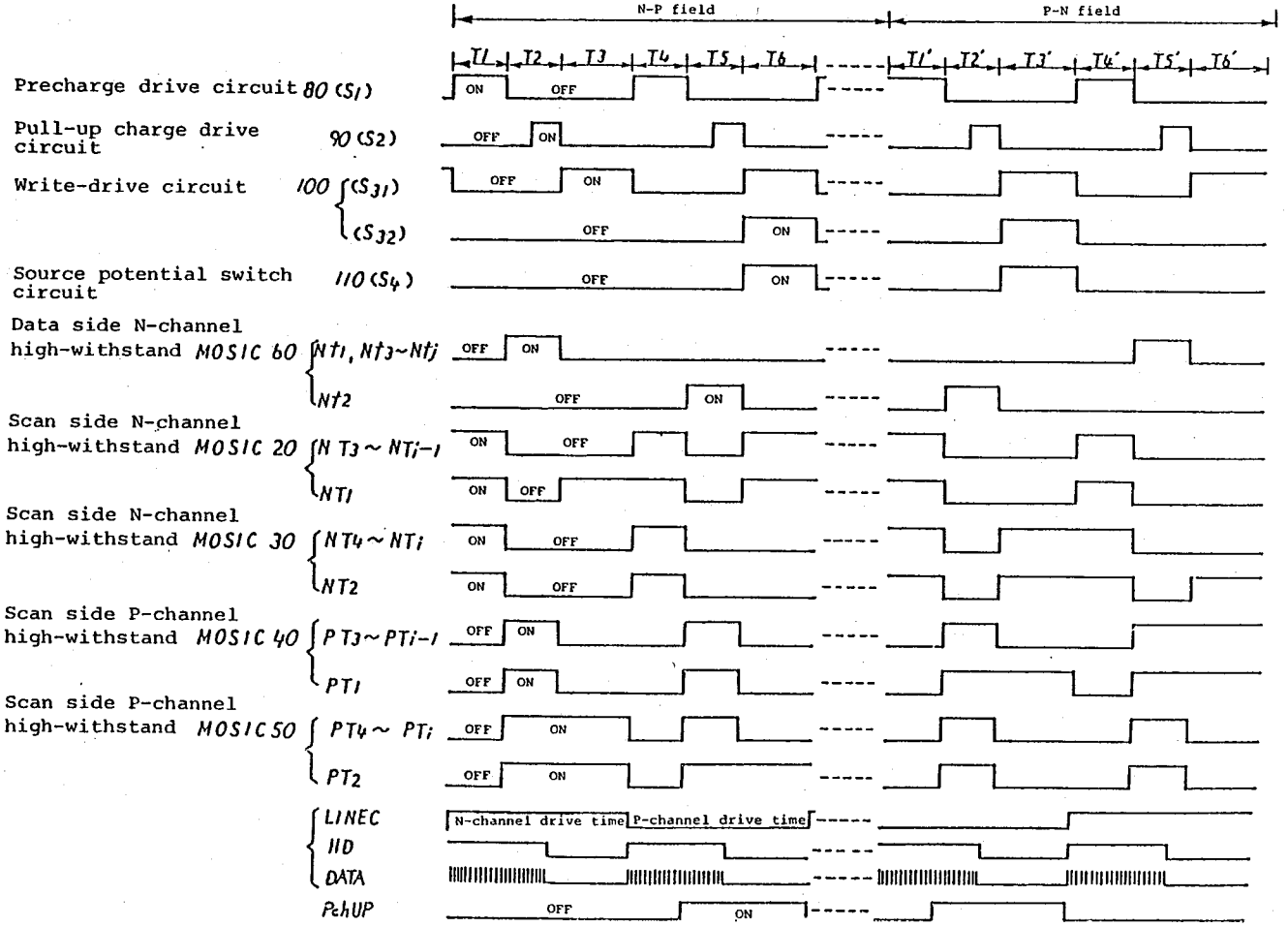
FIG. 8 is a time chart showing the ON-OFF timings of each high withstand MOS transistor, drive circuit and the potential switch circuit in FIG. 1 and their waveforms.

To overcome the above problem, the inventor presents a thin-film EL display panel drive circuit as disclosed in the following:

FIG. 1 shows the circuit construction of the thin-film EL display panel drive circuit used in the present invention. Parts common to FIG. 3 are given the same reference numbers, detailed explanation thereof being omitted. FIG. 7 is a block diagram showing the internal construction of the logic circuit (61) in FIG. 1. FIG. 8 is a time chart showing the ON-OFF times of each high-withstand MOS transistor, each drive circuit, and the potential switch circuit, as well as their waveforms.

Here, drive time for a line at which a positive write pulse is applied to picture elements by turning ON the N-channel high-withstand MOS transistor connected to the selected scan side electrode is called N-channel drive time. The drive time for a line at which a negative write pulse is applied to the picture elements by turning ON the P-channel high-withstand MOS transistor connected to the selected scan side electrode is called P-channel drive time.

The internal construction of the logic circuit (61), described in reference to FIG. 7, is as follows:

While drive for a certain line is conducted, the exclusive logical sum output of the display information DATA for the next line (1: emitting, 0: non-emitting) and the signal $\overline{LINEC}$ are sequentially input into a shift register (611) with a one line memory capacity. The information $DATA_{\oplus\overline{LINEC}}$ input to the shift resister is transferred to latch circuit (612) at the first of each drive time (N-channel drive time and P-channel drive time) and stored there until the end of each. (613) denotes a gate circuit which is only ON during steps $T_2$, $T_5$, . . . , and $T_2'$, $T_5'$ . . . to supply the latch circuit (612) output to corresponding gates of data side N-channel MOS transistors $Nt_1 \sim Nt_j$. For the other steps ($T_1$, $T_3$, $T_4$, $T_6$, . . . ), gate circuit is OFF so that latch circuit (612) output is not supplied to gates of N-channel MOS transistors.

The advantageous features of the drive circuit in the present invention are described as follows with reference to FIG. 1.

(120) denotes a drive voltage compensating control circuit that changes drive voltage VW at P-channel drive time according to the number of emitting picture elements in each drive line. In the present example, drive voltage at N-channel drive time is constant irrespective of the number of emitting picture elements, for voltage drop in N-channel MOS IC is very small and has minimal influence on display quality even when it varies depending upon the number of emitting picture elements.

In the drive voltage compensating control circuit (120), $C_s$ denotes a compensating voltage charging capacitor. LINEC signal is "1" at N-channel drive time and "0" at P-channel drive time. When the LINEC signal, the HD signal (data effective period signal) and the display information DATA, pass through the AND gates, capacitor $C_s$ is charged from power supply VC, with a supplemental voltage of about 30 V. Voltage VS stored in $C_s$ is VC (max.)$\sim$OV (min.) depending upon how long DATA is "1" (namely, the number of emitting picture elements). The P-channel UP signal is sent at the next P-channel write-drive time, whereby the sum of the normal write voltage VW' and the compensating voltage VS is supplied to the write-drive circuit (100).

Thus, in the driving method with alternate N-channel and P-channel driving times, compensating voltage VS is charged in the capacitor $C_s$ according to the number of emitting elements at the N-channel drive time. The sum of the above compensating voltage VS and normal write voltage VW' is applied to the write-drive circuit (100) at the next P-channel drive time, thereby compensating for voltage drop in the P-channel MOS IC due to the load current at the time of P-channel drive by the P-channel MOS IC having a large ON-resistance. Virtually constant voltage is thus applied to the electrodes in the thin-film EL display panel.

As understood from the above, the drive circuit used in the present invention provides a large ON-resistance but supplies constant voltage to the electrodes in the thin-film EL display panel, regardless of variations in the number of emitting picture elements. Accordingly luminance irregularity is eliminated and display quality improved.

<Other examples>

Figure 9:
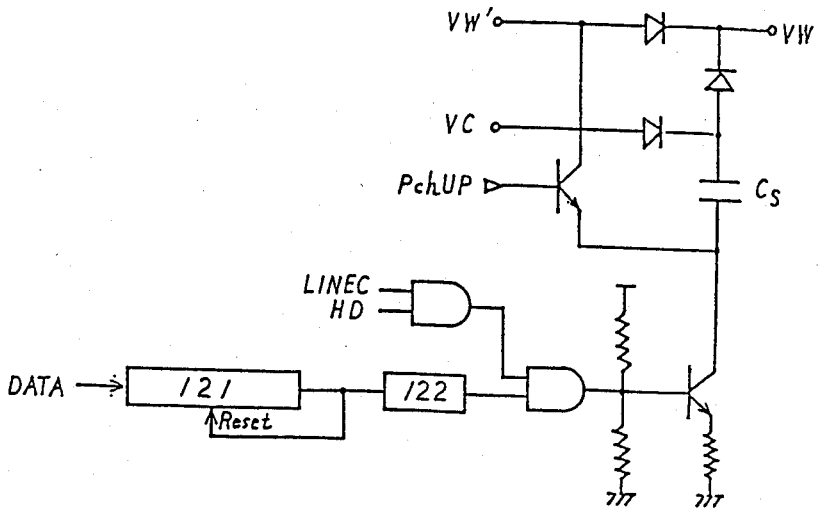
FIG. 9 is a circuit diagram showing another example of the drive voltage compensating control circuit (120) shown in FIG. 1.

In the above example, switching transistors are directly turned ON or OFF by the display information signal DATA to control capacitor $C_s$ for charging compensating voltage. When switching transistors do not have a corresponding capability to follow variations in the above display information signal DATA, an N-digit counter (N set to appropriate value) (121) and a one-shot multivibrator circuit (122) may be installed, as shown in FIG. 9. In this case, ON/OFF of switching transistors is controlled by a pulse signal of specified width output from the one-shot multivibrator circuit (122).

The above example, alternately repeating the N-channel drive and P-channel drive for each line, requires only one drive voltage compensating control circuit (120). In the ordinary drive circuit, where N-channel drive and P-channel drive are alternately repeated for each field, two drive voltage compensating control circuits may be installed for alternate use in the P-channel drive.

In the above example, drive voltage VW is compensated according to the number of emitting picture elements only at P-channel drive time. This is not to say that the same VW compensation cannot be performed at the N-channel drive timing as well when required to further improve display quality.

In place of the C charging circuit, a D/A converter circuit may be provided as a compensating voltage generating circuit to apply compensating voltage to write-drive circuit reference voltage.

As obvious from the detailed description above, the drive circuit in the present invention applies a constant or virtually constant emitting voltage to electrodes in the thin film EL display panel, irrespective of the number of emitting picture elements. Accordingly, irregular luminance caused by drive circuit ON-resistance—a conventional drive circuit problem—is avoided, and display quality is remarkably improved.

While only certain embodiments of the present invention have been described, it will be apparent to those skilled in the art that various changes and modifications may be made therein without departing from the spirit and scope of the present invention as claimed.

What is claimed is:

1. A thin-film EL display panel drive circuit comprising:

driving voltage means for providing a driving voltage to said EL display panel;

N-channel MOS transistors connected to scan side electrodes;

P-channel MOS transistors oonnected to scan side electrodes and said driving voltage means;

first activating means for activating means for activating said N-channel MOS transistors to apply write pulses to picture elements on said scan side electrodes to which said N-channel MOS transistors are connected;

second activating means for activating said P-channel MOS transistors to apply write pulses to picture elements on said scan side electrodes to which said P-channel MOS transistors are connected;

voltage compensating means for compensating for voltage drops in said P-channel MOS transistors by adding voltage to said driving voltage supplied by said driving voltage means, said compensation being determined in accordance with variations in the number of emitting picture elements.

2. The thin-film EL display panel drive circuit of claim 1, wherein said P-channel MOS transistors and said N-channel MOS transistors are alternately activated or deactivated.

3. The thin-film EL display panel drive circuit of claim 2, wherein said voltage for compensating the voltage drop is stored in said driving voltage means while said N-channel MOS transistors are activated.

4. The thin-film EL display panel drive circuit of claim 2, wherein said compensating voltage is added to the drive voltage supplied by said driving voltage means when said P-channel MOS transistors are activated.

5. A drive system for a thin-film electroluminescent (EL) matrix display panel comprising:

data side electrodes formed on one major surface of the thin-film electroluminescent (EL) matrix display panel and generally extending in a first direction;

scanning side electrodes formed on the opposing major surface of said thin-film electroluminescent (EL) matrix display panel in a second direction substantialiy perpendicular to said first direction, said scanning side electrodes being alternately divided into odd number scanning electrodes and even number scanning electrodes;

a pull-up charge driving circuit;

a precharge driving circuit;

a write driving circuit for providing first and second write pulses;

a source level switching circuit;

an odd side N-channel high voltage MOS driver connected to said odd number scanning electrodes at one end thereof, the other end of said odd side N-channel high voltage MOS driver being connected to said source level switching circuit;

an odd side P-channel high voltage MOS driver connected to said odd number scanning electrodes at one end thereof, the other end of said odd side P-channel high voltage MOS driver being connected to said pull-up charge driving circuit and said write driving circuit;

an even side N-channel high voltage MOS driver connected to said even number scanning electrodes at one end thereof, the other end of said even side N-channel high voltage MOS driver being connected to said source level switching circuit;

an even side P-channel high voltage MOS driver connected to said even number scanning electrodes at one end thereof, the other end of said even side P-channel high voltage MOS driver being connected to said pull-up charge driving circuit and said write driving circuit; and a data side N-channel high voltage MOS driver connected to said data side electrodes at one end thereof, the other end of said data side N-channel high voltage MOS driver being connected to said precharge driving circuit; said MOS drivers collectively driving said data side electrodes add said scanning side electrodes to define a number of emitting elements;

detecting means for detecting the number of emitting elements for each scan side emitting line in a first driving period;

voltage compensating means connected to said write driving circuit for compensating for voltage drops in said odd and even side P-channel high voltage MOS drivers by adding a voltage in a second driving period to said second write pulse based upon the variations in the number of emitting elements detected in said first driving period;

said odd side P-channel MOS driver providing said first write pulse to said odd number scanning electrodes when an even number scanning electrode is selected in said first driving period and providing said second write pulse to a selected odd number scanning electrode when in said second driving period;

said even-side P-channel MOS driver providing said first write pulse to said even number scanning electrodes when an odd number scanning electrode is selected in said first driving period and providing said second write pulse to a selected even number scanning electrode in said second driving period;

said first write pulse provided being of a polarity opposite to said second write pulse which is provided.

6. The thin-film EL display panel drive circuit of claim 1 wherein said compensating means adds a compensating voltage to said driving voltage supplied by said driving voltage means so as to apply a substantially constant voltage to said scan side electrodes.

* * * * *